United States Patent [19]

Hart et al.

[11] Patent Number: 4,569,094

[45] Date of Patent: Feb. 11, 1986

[54] SELF-POWERED LIFT

[76] Inventors: Lawrence D. Hart; Melville D. Hart, Jr., both of 9501 Business 83 #546, Harlingen, Tex. 78552

[21] Appl. No.: 544,887

[22] Filed: Oct. 24, 1983

[51] Int. Cl.[4] ..... A61G 7/10

[52] U.S. Cl. ..... 5/81 R; 5/86

[58] Field of Search ..... 5/81 R, 81 B, 83, 86, 5/87, 88; 4/560–566; 414/DIG. 921

[56] References Cited

U.S. PATENT DOCUMENTS

| | | | |
|---|---|---|---|
| 2,572,149 | 10/1951 | Hind et al. . | |
| 2,714,922 | 8/1955 | McKibban et al. . | |
| 2,914,110 | 11/1959 | Schultz | 5/87 |
| 3,023,048 | 2/1962 | Barton | 297/330 |
| 3,374,493 | 3/1968 | Herrera | 5/86 |
| 3,469,269 | 9/1969 | Brown | 5/86 |
| 3,694,829 | 10/1972 | Bakker | 5/81 R |
| 3,882,555 | 5/1975 | Edlund | 5/81 R |
| 3,940,808 | 3/1976 | Petrini | 5/81 R |
| 3,962,767 | 6/1976 | James | 5/86 |
| 3,997,926 | 12/1976 | England | 5/81 R |
| 4,010,499 | 3/1977 | Davis et al. | 5/81 R |
| 4,054,319 | 10/1977 | Fogg et al. | 297/330 |
| 4,076,304 | 2/1978 | Deucher | 297/45 |
| 4,155,416 | 5/1979 | Ausmus | 5/81 R |
| 4,157,593 | 6/1979 | Kristensson | 5/81 R |
| 4,232,412 | 11/1980 | Petrini | 5/86 |
| 4,435,863 | 3/1984 | Lerich | 5/81 B |

*Primary Examiner*—Alexander Grosz

[57] ABSTRACT

A lift is disclosed which enables an invalid to move without the aid of another person, from a seated position to a standing, or new seated position. The unit supports the body such that minimal upper body strength is required, and body size is accommodated by simple adjustments of the lift arm length and height.

13 Claims, 10 Drawing Figures

SELF-POWERED LIFT

SUMMARY OF THE INVENTION

This invention pertains to apparatus for assisting physically handicapped persons in moving about and more particularly to an apparatus for enabling such a person unaided to move from a wheelchair to a bed or other furniture.

Previously known patent assist apparatus is disclosed in a number of prior art patents turned up in a search of the files of the U.S. Patent and Trademark Office as follows:

U.S. Pat. No. 2,572,149—Hind
U.S. Pat. No. 2,714,922—McKibban et al
U.S. Pat. No. 2,914,110—Schulte
U.S. Pat. No. 3,023,048—Barton
U.S. Pat. No. 3,374,493—Herrera
U.S. Pat. No. 3,469,269—Brown
U.S. Pat. No. 3,694,829—Bakker
U.S. Pat. No. 3,882,555—Edlund
U.S. Pat. No. 3,940,808—Petrini
U.S. Pat. No. 3,962,737—James
U.S. Pat. No. 3,997,926—England
U.S. Pat. No. 4,010,499—Davis
U.S. Pat. No. 4,054,319—Fogg
U.S. Pat. No. 4,076,304—Deucher
U.S. Pat. No. 4,155,416—Ausmus
U.S. Pat. No. 4,157,593—Kristensson
U.S. Pat. No. 4,232,412—Petrini However, none of the foregoing patents shows a construction as hereinafter described and claimed.

According to the invention there is provided a stand, which may be mobile or stationary, comprising a base, surmounting which is a turntable carrying an upright. On the front of the upright is disposed a kneeboard which the person in the wheelchair can move to and position their knees in contact with. At opposite ends of the kneeboard, are pivotally mounted arms, the outer ends of which carry a belt to be placed under the person's seat. Downward movement of the inner ends of the arms is effected at the command of the user by an electric motor driven lead screw passing through a nut carried by a beam connecting the inner ends of the arms. Such downward movement of the inner ends of the arms elevates the outer ends of the arms and the seat belt, and the person is thereby moved to a standing position as their knees straighten out. The user then pivots the upright about the base to position himself with the backs of his knees against the bed or other furniture and reverses the motor to lower themself to a seated position thereon.

This mechanism enables a person to move from a seated position, to a standing position, rotate, and return to a different seated position. The unit captures the body such that minimal upper body strength is needed and a full standing position is not required prior to rotation. Body size is accommodated by simple adjustments.

An embodiment of this invention is disclosed in which a means of lifting an invalid from a seated to a standing position is mounted on a pedestal equipped with a turntable and base. The pedestal and base combine to provide a mobile frame for the lifting means. The turntable allows the pedestal to rotate on the base and therefore enables an invalid to use the lift to change from one seated position to another.

Additionally, it is an object of this invention that the lifting means may also be mounted in any suitable stationary frame where a singular standing position is desired by an invalid. (i.e., in front of a sink, basin, or work bench.) The position of the lifting means may be adjusted up or down, and such adjustment along with telescopic arms renders the lift adjustable to the invalid's body size.

BRIEF DESCRIPTION OF THE DRAWINGS

For a detailed description of a preferred embodiment of the invention, reference will be made to the accompanying scale drawings wherein.

MATERIALS

The apparatus is preferably made of metal, e.g. steel, except for the straps and belt which are preferably made of flexible natural or artificial plastics material such as leather or Nylon, the wheels, which may have rubber tires, and the electrical components, which are made of conventional insulating and conducting elements.

DETAILED DESCRIPTION

Overall Combination

Figure 1:
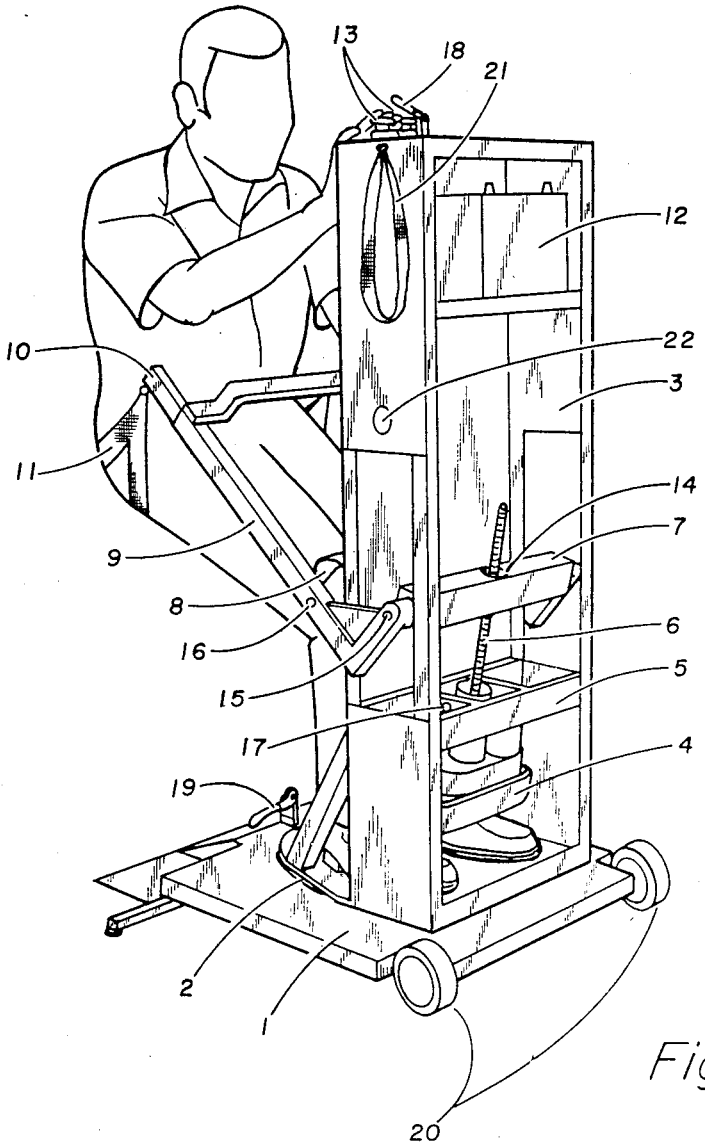
FIG. 1 is a perspective view of an invalid or flexible paraplegic supported in an intermediate position on a self-powered mobile body lift mechanism embodying the invention.
Figure 2:
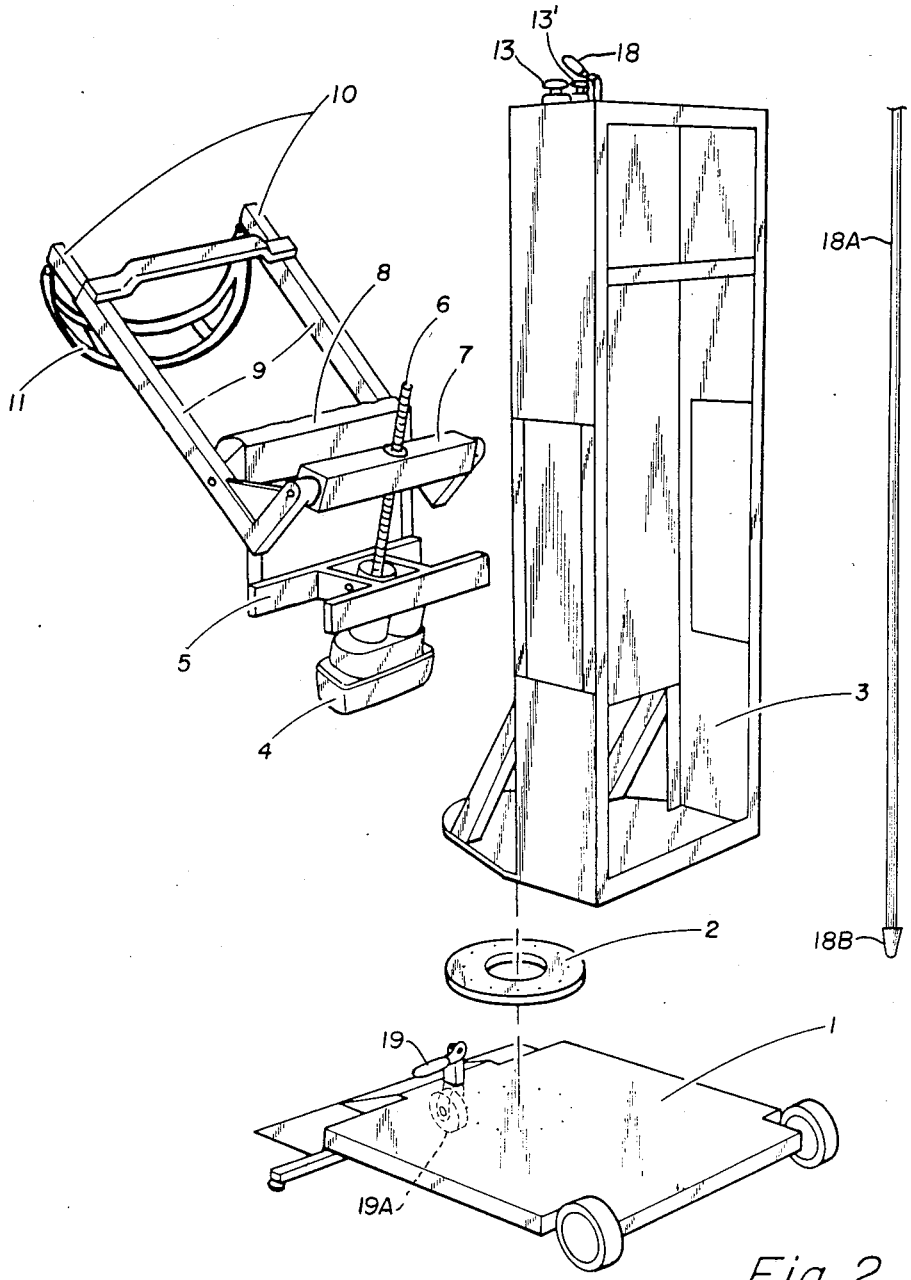
FIG. 2 is an exploded perspective view illustrating the four main components of the lift.

As shown in FIG. 1 and FIG. 2 the self-powered mobile body lift includes four major components. The base(1), ball bearing turntable(2), pedestal(3), i.e. an upright having a lower or foot portion and an upper or lift group receiving portion; and the motorized lift group (4–11). The base(1) and the pedestal(3) are joined together by attachment to opposite sides of the ball bearing turntable (2). The motorized lift group is mounted inside the pedestal and includes a motor(4), motor frame(5), lead screw(6), beam (7), kneeboard(8), two lift arms(9), two telescopic inner arms (10) and a seat strap(11).

To appreciate the scale of the drawings, it may be noted that turntable(2) there shown is one foot in outer diameter.

Motor Drive

The motor(4) is powered by a battery(12). The motor is operated by two electrical switches(13) (and 13') which control the direction of rotation of the motor(4). The switches are of the kind which stay closed only so long as held in that position by the user. The motor is mounted inside the motor frame(5) by pins (17). A lead screw(6) is attached to the motor(4) and the lead screw(6) passes through a ball bearing nut(14) captured in beam(7). On each end of beam(7) are attached two outer arms(9) by means of pins(15). The outer arms(9)

are mounted to the knee board(8) by pins(16). The telescopic inner arms(10) slide inside the outer arms(9).

The motorized lift group is mounted through the motor frame(5) and knee board(8) inside the pedestal(3). The knee board(8) and motor frame(5) do not move with respect to each other and provide the mechanical frame of the motorized lift group. During operation of the lift the motor(4) pivots on pins(17), and the beam(7) pivots on pins(15). This pivoting action between the motor(4) and beam(7) reduces bending forces on the lead screw(6).

Size Adjustment

The body lift may be adjusted to fit any body size by lowering or raising the motorized lift group (4–11) as a unit inside the pedestal(3). This is equivalent to setting the arm (9) height. Proper adjustment is made when pin(16) is at the same height as the subject knee joint, and the two inner arms (10) are slid inside the outer arms(9) so that the end of the arms coincide with the invalid's hip joints.

Lift to Standing Position

An invalid will be lifted from a seated position to a standing position against the pedestal(3) when the proper electrical switch (13)(13') activates the motor(4). The motor (4) rotates the lead screw(6) and pulls beam(7) downward by means of the ball bearing nut(14) captured in beam(7). As beam(7) moves downward the arm group(9,10) pivots on pins(16) and raises the invalid supported by the seat strap(11) to a standing position.

Rotation

Figure 3A:
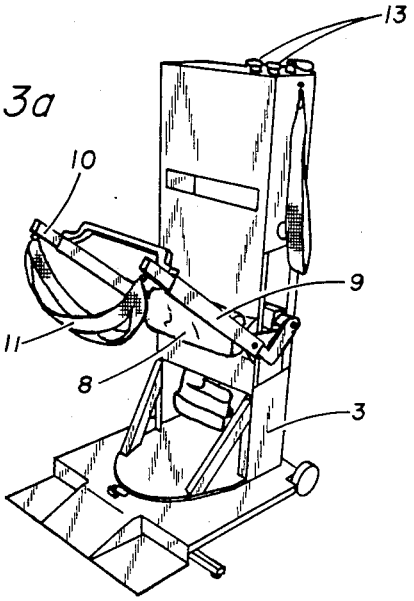
FIG. 3*a* is a perspective view of the lift from the occupant side. The pedestal has not been rotated.
Figure 3B:
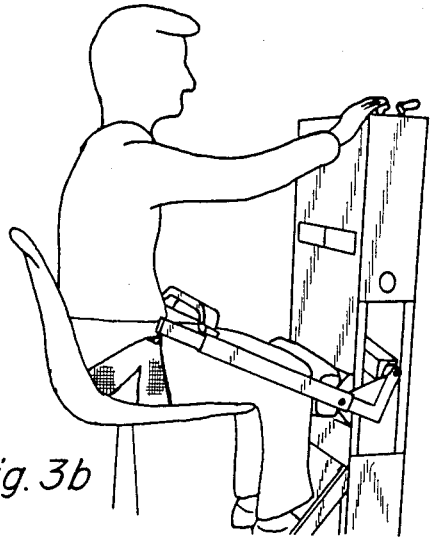
FIGS. 3*b*–3*e* are sequential views of an invalid or paraplegic being moved from a seated position; to a standing position, and then to a new seated position.
Figure 3C:
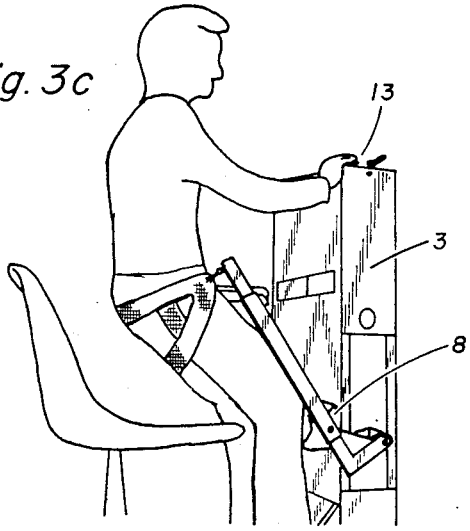
Figure 3D:
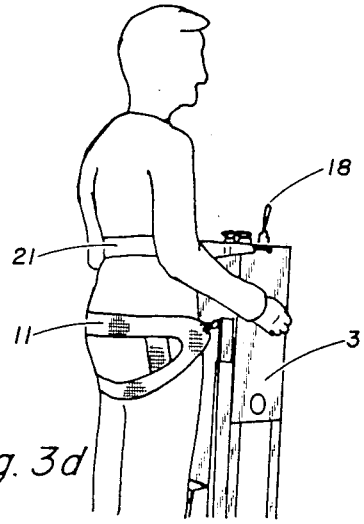
Figure 3E:
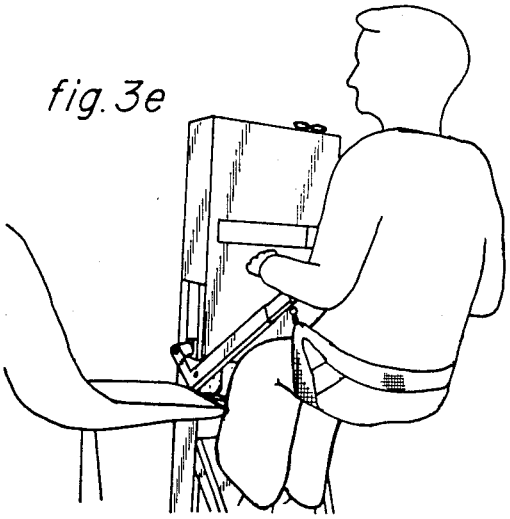
Figure 3F:
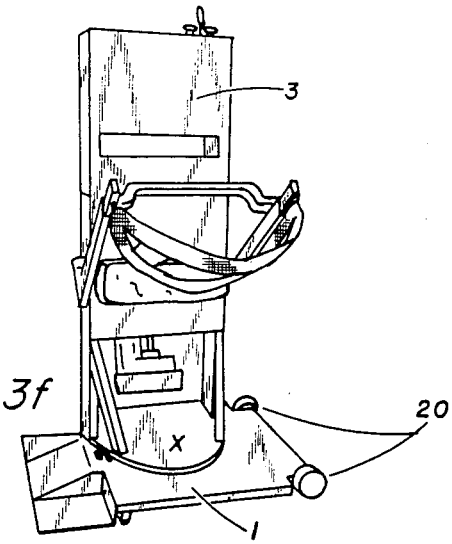
FIG. 3*f* is a perspective view of the lift from the occupant side. The pedestal has been rotated 90 degrees.

FIG. 3*f* shows the rotated configuration of the lift. An important feature of the invention is the offset rotation of the pedestal(3). The point of rotation of the pedestal(3) is shown in FIG. 3*f* by the 'x'. This rotation construction moves the mass of the pedestal(3) toward the opposite side of the base(1) from the side of the desired seating position. This center of gravity shift offsets the weight of the person being lifted when in the rotated position. This results in the ability to employ a base(1) with a narrow distance between the wheels(20).

Rotation Lock

Referring once more to FIG. 1, a locking lever(18) is provided to selectively prevent rotation of the pedestal(3) with respect to the base(1). When the lever(18) is raised it causes a rod(18A) equipped with a rubber foot(18B) to extend down through the pedestal(3) onto the base(1) and prevent rotation of the pedestal. A similar lever(19) lowers a singular ball caster(19A) located under the base(1), which raises the rear of base(1). The ball caster and two forward wheels (20) enable the lift to be moved to any desired location.

Straps

Figure 5:
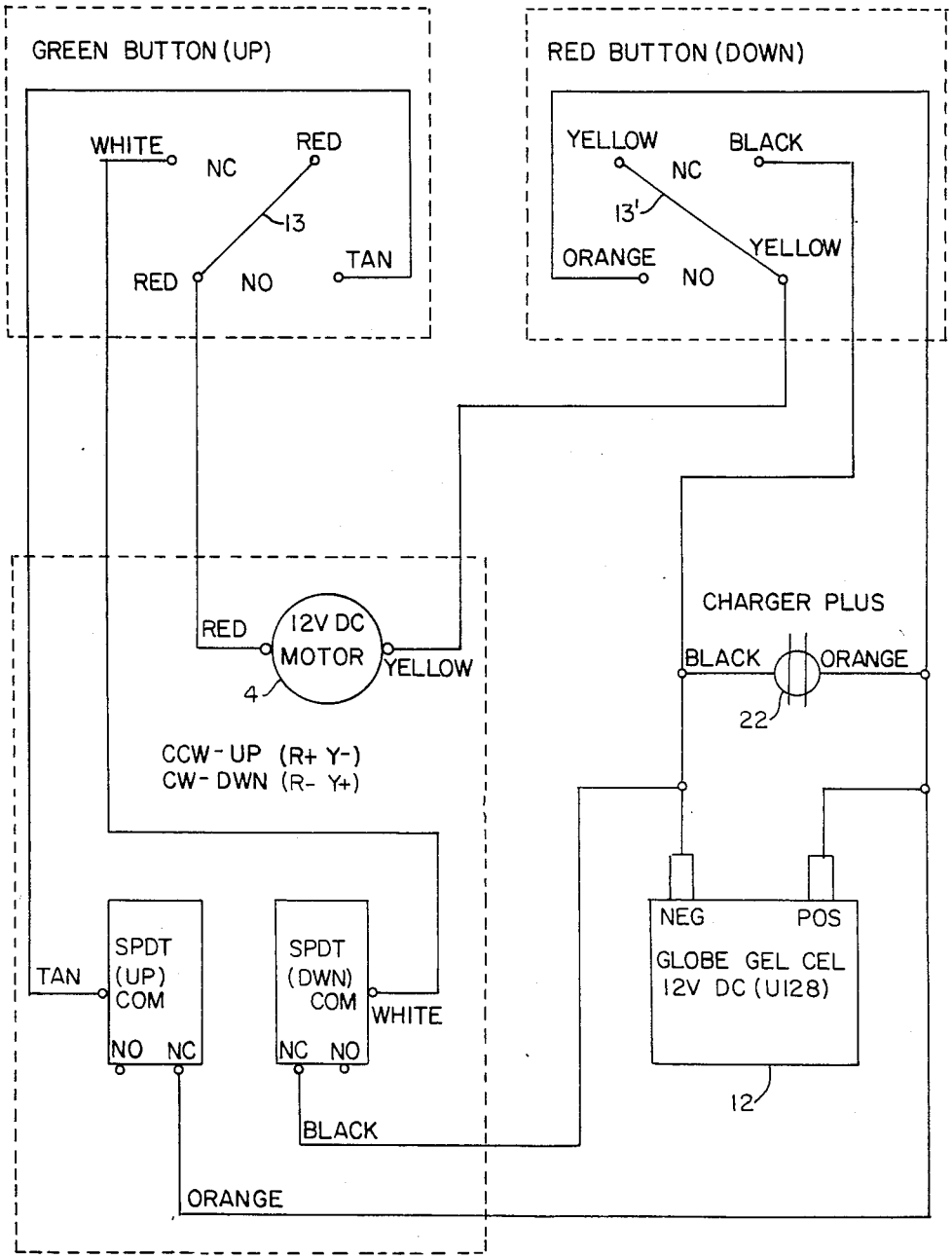
FIG. 5 is a wiring diagram showing the electric circuits of apparatus embodying the invention.

The seat strap supports the invalid when being raised from or lowered to a seated position. A lower back strap(21) is carried on a hook near the top of pedestal(3) at one side thereof and may be removed from the hook and fastened on opposite sides of the pedestal as shown in FIG. 5(*d*) to reduce back strain when the invalid remains in a standing position for an extended period of time.

Recharge

An electrical receptacle(22) is provided to connect an *external battery charger to the battery(12). (See also* FIG. 3).

Operation

The operation of the invalid lift is best understood in conjunction with FIGS. 3*a*–3*e*. The self-powered mobile body lift is shown in FIG. 3*a* from the occupant side of the lift. The lift arms(9) are in an intermediate position and the seat strap(11) is connected to both telescoping inner arms(10).

To use the lift an invalid would position themself in front of the pedestal(3), unclip one side of the seat strap(11) from arm(10), and lower the arm assembly by activating the appropriate switch(13 or 13'). By placing the seat strap(11) under the buttocks and refastening it to arm(10), and positioning their knees in contact with the knee board(8), the person is ready to be elevated to a standing position as shown in FIG. 3*d*. The user's hand is on the electrical operating button(13, 13').

Referring now to FIG. 5, pushing the UP button(13) causes the person to be lifted from a seated position. In FIG. 3*c* the person has been lifted to an intermediate position. The knees are still in contact with the knee board(8) and their right hand continues to depress the electrical switch(13). The electrical switch must remain depressed to operate the lift. It should be noted that the seat strap(11) in addition to lifting the person, is now starting to pull the body towards the pedestal(3). The fact that the left hand (not shown) may be free indicates the stability of the apparatus.

A full standing position has been reached in FIG. 3*d*. The seat strap(11) holds the body against the pedestal(3). The lower back strap(21) is shown in use for illustration and is only employed for extended periods of standing. The lever(18) has been moved to unlock the pedestal(3) from the base(1) and enable rotation of the pedestal(3), allowing the person to move to a new seated position. Strap(21) around the midback reduces fatigue when standing for extended periods and is not used during simple transfers.

In FIG. 3*e* the DOWN button(13'), see also FIG. 5, has been pushed and the person has rotated themself and the pedestal, e.g. 90 degrees, and lowered to a new seated position. This new seated position could be inside an automobile, onto a chair, or onto a bathroom tub or toilet.

FIG. 3*f* shows the pedestal rotated on the base. The locking lever(18) on top of the pedestal, see also FIG. 3(*d*) and FIG. 1, prevents rotation when it is in the down position (FIGS. 3*a*, 3*b*, 3*c*, 3*e*).

Geometry

Figure 4:
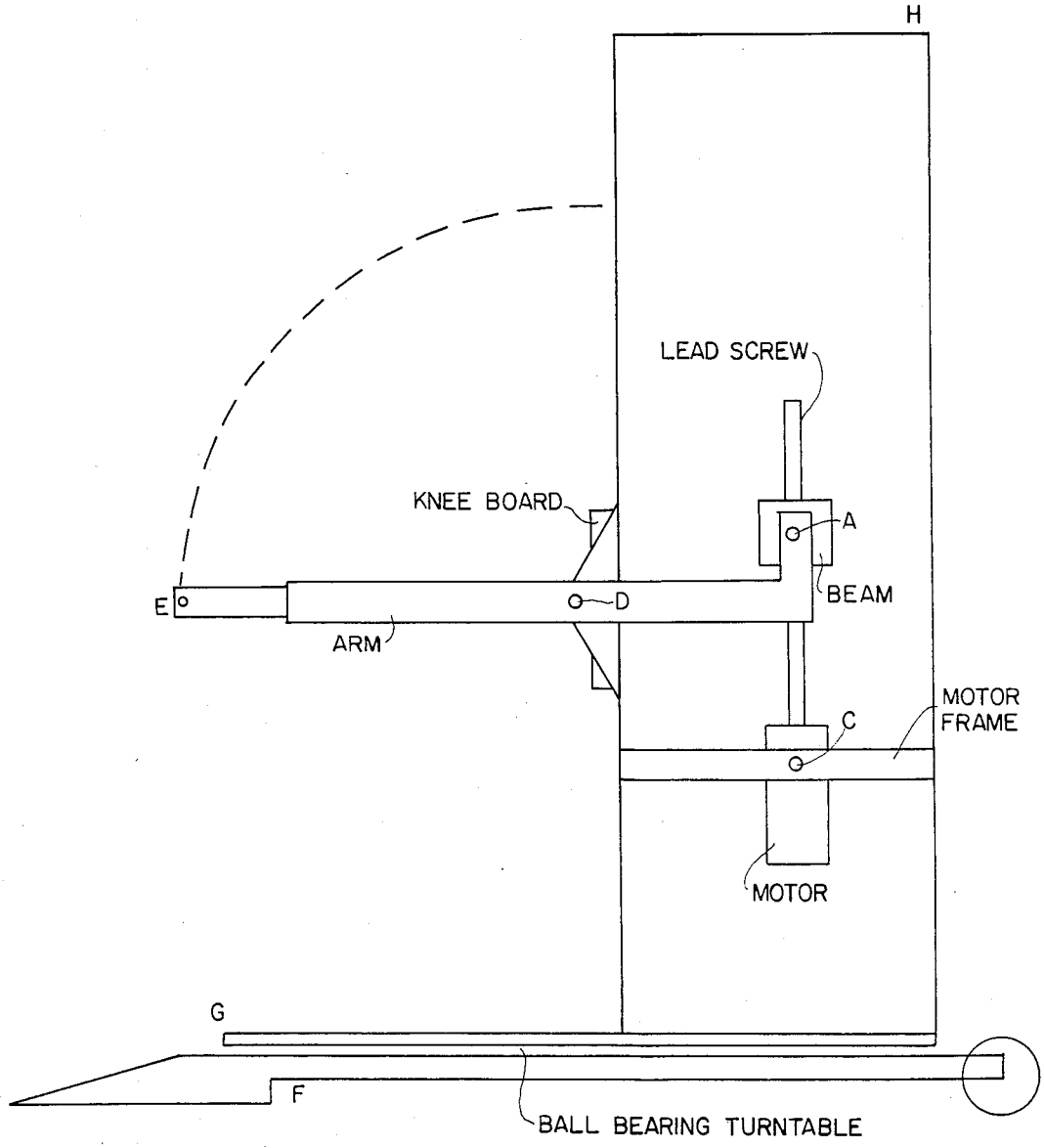
FIG. 4 is a schematic, more or less to scale, side elevation of apparatus embodying the invention.

With reference to FIGS. 1, 2, and 4:

The lift is powered by a 12 v DC motor(4) and battery(12) located inside the pedestal(3). Lifting action is accomplished through ball bearing lead screw(16) which drives the beam up and down through a nut(14) in the beam. On each end of the beam are attached arms with pins at point A. The arms are mounted to the knee board(8) with pins(16) at point D. The motor is mounted to the motor frame(15) with pins(17) at point C.

As the motor turns the lead screw and pulls beam(7) down, arms(9) pivot about point D, resulting in point E following the dotted arc. As shown in FIG. 4, the dotted arc is a portion of a circle, point D being stationary relative to the pedastal during operation of the apparatus. During this motion the motor pivots at point C and the beam pivots at point A (Point A also moves in an arc). This action between the motor and beam reduces bending forces on the lead screw.

A person will be lifted to a standing position with no discomfort if point D is centered at the pivot point of the knee, and point E is centered on the buttocks. Thus, the pivot points D of the two arms(9) define a horizontal pivot axis extending in the same direction as the knee support means(8), as seen in FIG. 1 and 2, point D being identified in FIG. 1 by reference number (16). Point D is adjusted by moving the knee board(8), see also FIG. 1, up or down. Any suitable means may be employed to effect adjustment of the height of the kneeboard relative to the pedastal. The knee board and motor frame move as a unit to maintain proper relationship of the arms to the pedestal. Point E is adjusted by the telescopic nature of the ends of the arms. A strap at point E, e.g. strap 11, FIG. 1 supports the person during motion. Since the distance from a person's knee to his buttocks remains constant from sitting to standing, points D to E do so also.

The person is held in the standing position between the strap(11) on the buttocks and the pedestal (FIG. 3*d*). The ball bearing turntable(2) enables the standing person to pivot to a new position. The motor is reversed and the person is lowered into a new seated position. The placement of the turntable results in adjustment of the center of gravity during rotation. Stabilizer legs at point F have not been needed on the present prototype.

At G a toggle clamp(19) lowers a single caster to jack up the rear of the lift to move it to a new location. An additional toggle clamp(18) at H locks the turntable during lifting.

Referring now to FIG. 5, there is shown the wiring diagram for the electric circuit of the apparatus shown in FIGS. 1–4. The motor (4) is connected via the terminal marked RED to the RED terminal of push button switch (13) and via the terminal marked YELLOW to the YELLOW terminal of push button switch (13').

Push button switch (13) is shown to include three terminals marked WHITE, RED, and GREEN respectively, and to include a moveable switch blade connected to the RED terminal, the blade also being marked RED. It is further indicated that the normally closed (NC) position of the switch is with the switch blade contacting the WHITE terminal, the TAN terminal being normally open (NO). Thus, the RED terminal of motor (4) is normally connected to the WHITE terminal of the switch which in turn is connected by the WHITE wire to the common (COM) terminal of the single pole double pole switch (SPDT) marked (DWN). The normally closed (NC) terminal of the (SPDT) switch marked (DWN) is connected by the BLACK wire to the negative (NEG) pole of battery (12).

The positive (POS) pole of battery (12) is connected by the ORANGE wire to the normally closed (NC) terminal of the single pole double throw switch (SPDT) marked (UP). The common (COM) terminal of the SPDT switch marked (UP) is connected by the TAN wire to the TAN terminal of push button switch (13), which terminal, as previously noted, is normally open, so the motor is not energized.

Push button switch (13') is shown to include three terminals marked BLACK, YELLOW, and ORANGE, respectively, and to include a moveable switch blade connected by the YELLOW terminal, the blade also being marked YELLOW. It is further indicated that the normally closed (NC) position of the switch is with the switch blade contacting the BLACK terminal, the ORANGE terminal being normally open (NO). Thus, the YELLOW terminal of motor (4) is normally also connected by the BLACK wire to the negative (NEG) terminal of battery (12).

The positive (POS) pole of battery (12) in also connected by the ORANGE wire to the ORANGE terminal of push button switch (13) which terminal, as previously noted, is normally open, so the motor is not energized.

If either one of push button switches (13), (13') is actuated to close its normally open contact, TAN or ORANGE, the motor will be energized in one direction or the other, UP for switch (13) or DOWN for switch (13'), as indicated on the wiring diagram.

As indicated on the diagram, a CCW (counter clockwise) motor rotation effects an UP motion, with the motor's RED (R) terminal positive (+) and the motor's YELLOW (Y) terminal negative (−). A CW (clockwise) motor rotation effects a down (DWN) motion, with the motor's RED (R) terminal negative (−) and the motor's YELLOW (Y) terminal positive (+).

If the SPOT switch marked (UP) is moved to open position, the motor can not be energized in the UP direction. If the SPOT switch marked (DWN) is moved to the open position, the motor can not be energized in the down (DWN) direction. If both of the SPOT switches are moved to the open position, the motor cannot be energized to move in either direction.

Connected across the BLACK and ORANGE wires is receptacle 22 adapted to receive the plug on the end of an electric cord leading to a battery charger (not shown).

Although not present on the apparatus described above, it is possible to motorize the turntable and the entire lift. The lifting mechanism could be an addition to a wheelchair to obtain complete mobility.

While a preferred embodiment of the invention has been shown and described, modifications thereof can be made by one skilled in the art without departing from the spirit of the invention.

We claim:

1. Personal transfer apparatus comprising:

a base, positioning means including an upright and knee support means carried by the upright, means rotatably mounting the positioning means on the base, lever means pivotally connected to the support means for pivoting about a horizontal pivot axis extending in the same direction as and adjacent to and colevel with a part of the knee support means that is adapted to engage the front of the knees of a person seated facing the apparatus, body engagement means carried by a portion of the lever means at a distance from said pivot axis, and means for pivoting the lever means to move a body between seated and standing positions, the upright and knee support means and means for pivoting the lever means being mounted at the opposite side of the axis of the means rotatably mounting the positioning means on the base from the side of said axis at which is disposed said body engagement means, thereby to balance the apparatus when in use.

2. Apparatus according to claim 1 including releasable lock means for locking the upright against rotation relative to the base.

3. Apparatus according to claim 2 wherein the means rotatably mounting the upright on the base is a turntable and the lock means includes toggle actuated rod means carried by the upright engageable with the base to lock the base against rotation about the axis of the turntable.

4. Apparatus according to claim 1 wherein the base includes foot means, wheel means, and caster means, said caster being movable between a projected position elevating the base so that its weight is supported on the caster means and wheel means and a position in which the caster means is retracted, and including a toggle clamp releasably to hold the caster in projected position.

5. Apparatus according to claim 1 wherein said body engagement means is a seat adapted to engage a person's buttocks.

6. Apparatus according to claim 1, said base having a perimetric support means maintaining balance in all positions of rotation of the upright relative to the base.

7. Apparatus according to claim 6, said perimetric support means comprising rotatable support means and fixed support means.

8. Apparatus according to claim 1, said means for pivoting the lever means including a motor, a lead screw connected to the motor shaft and nut engaging the lead screw and connected to the lever means.

9. Apparatus according to claim 8, said motor being pivotally mounted on the upright.

10. Apparatus according to claim 9, wherein the lever means includes two lever arms and a beam pivotally connected between the lever arms, said nut being mounted in said beam.

11. Apparatus according to claim 8, wherein the knee support means and motor are adjustably mounted relative to the upright, being movable as a unit.

12. Apparatus according to claim 1, wherein the lever means is of adjustable length.

13. Personal transfer apparatus comprising:

a base, positioning means including an upright and knee support means carried by the upright, means rotatably mounting the positioning means on the base, lever means pivotally connected to said positioning means for pivoting about a horizontal pivot axis extending in the same direction and adjacent to and colevel with a part of the knee support means that is adapted to engage with the front of the knee of a person seated facing the apparatus, body engagement means carried by a portion of the lever means at a distance from said horizontal axis, said body engagement means being a seat adapted to engage a person's buttocks and means for pivoting the lever means between a seating position in which the lever means extends from said pivot axis to position the seat under a seated person's buttocks and a standing position in which the lever means extends from said pivot axis to position the seat adjacent a standing person's buttocks, to move a body between seated and standing positions, the person's body bending at the hips during the transition between such positions.

* * * * *

UNITED STATES PATENT AND TRADEMARK OFFICE

CERTIFICATE OF CORRECTION

PATENT NO. : 4,569,094

DATED : February 11, 1986

INVENTOR(S) : Lawrence D. Hart; Melville D. Hart

It is certified that error appears in the above—identified patent and that said Letters Patent is hereby corrected as shown below:

In Column 2, line 60, after "(and 13' ", insert ---See Fig. 5)---.

In Column 3, line 66, after "in," change "Fig. 5(d) to ---Fig. 3(d)---.

In Column 8, line 25, after "buttocks", add --- , ---.

Signed and Sealed this

*Eighth* Day of *July 1986*

[SEAL]

*Attest:*

DONALD J. QUIGG

*Attesting Officer*

*Commissioner of Patents and Trademarks*